United States Patent [19]

Tam

[11] 4,227,347

[45] Oct. 14, 1980

[54] TWO MOTOR DRIVE FOR A WAFER PROCESSING MACHINE

[75] Inventor: Johann Tam, Saratoga, Calif.

[73] Assignee: Silicon Valley Group, Inc., Sunnyvale, Calif.

[21] Appl. No.: 942,268

[22] Filed: Sep. 14, 1978

[51] Int. Cl.[3] ..... B24B 47/00

[52] U.S. Cl. ..... 51/235; 15/21 D; 15/268; 51/134.5 R; 51/165.72; 51/237 R; 118/52; 318/40

[58] Field of Search ..... 118/50, 52; 318/40, 318/48; 51/237 R, 235, 134.5 R, 165.72; 15/268, 21 D

[56] References Cited

U.S. PATENT DOCUMENTS

| | | | |
|---|---|---|---|
| 1,755,079 | 4/1930 | Schieseler | 318/48 |
| 3,434,025 | 3/1969 | Parkinson | 318/48 X |
| 3,730,134 | 5/1973 | Kadi | 51/235 |
| 3,863,398 | 2/1975 | Moser | 51/134.5 R |

*Primary Examiner*—Harold D. Whitehead
*Attorney, Agent, or Firm*—Donald C. Feix

[57] ABSTRACT

A drive mechanism for a wafer processing machine of the kind which holds a silicon wafer on a vacuum chuck and rotates the wafer for processing operations on the wafer periphery or upper surface incorporates a low-speed motor, a high-speed motor and an overrunning clutch. The low-speed motor is connected to a drive shaft for the chuck through the overrunning clutch and rotates the chuck and wafer at a relatively low and precisely-controlled speed while the edge of the wafer is contoured by a grinding wheel or while the upper surface is mechanically cleaned by a brush engaged with the upper surface of the wafer. The high-speed motor is directly connected to the drive shaft and, when energized for a rinsing and drying operation, rotates the chuck and wafer in the same direction of rotation as the low-speed motor but at high speed while the wafer is being rinsed and dried after the grinding or cleaning operation. During the grinding or cleaning operation the high-speed motor is energized toward rotation in a direction opposed to the direction of rotation produced by the low-speed motor. The biasing torque so produced insures against any slack or rebounding through the overrunning clutch which could result in skipping or chattering of the engagement of the grinding wheel with the periphery of the wafer during the contouring of the periphery of the wafer or which could result in loss of clamping contact between the chuck and the wafer.

1 Claim, 1 Drawing Figure

TWO MOTOR DRIVE FOR A WAFER PROCESSING MACHINE

BACKGROUND OF THE INVENTION

This invention relates to a wafer processing machine. It has particular application to a machine of the kind in which a silicon wafer is held on the top of a rotatable chuck and is rotated under precise speed control at two widely disparately speed ranges in the course of performing processing operations on the wafer periphery and upper surfaces. For example, in one particular application of the present invention a silicon wafer is rotated at low speed during a grinding operation while a grinding wheel engages the periphery of the wafer to eliminate sharp corners of the edge profile of the wafer. The wafer is then rotated at high speed during a subsequent rinsing and drying operation.

Silicon wafers are used as the base material in the manufacture of semiconductor devices.

The wafers are cut from bar stock; and before integrated circuits or chips are fabricated on the wafer (by well-known techniques, such as depositing, etching, and the like) the entire peripheral edge of the wafer is contoured to a pre-selected configuration and finish by grinding the edge with a grinding wheel.

In the edge-grinding operation, the wafer is held on top of a chuck with the periphery of the wafer extending outwardly from the chuck for engagement by a grinding wheel. The chuck is rotated at slow speed while the grinding wheel grinds the edge to the proper contour.

The wafers range in diametral size from 2 inch to 5 inch, usually in one inch increments. The purpose of grinding is to eliminate the sharp corners of the edge profile of the wafer. The usual profile obtained is that of a semicircular shape (as viewed in elevation through a cross section of the edge). Rounding off the sharp edges to such a semicircular shape renders the wafer less susceptible to chipping damage in subsequent automatic machine handling. Other benefits obtained from this rounded edge include reduced photo resist edge beading and reduced epitaxial edge crown.

After the edge of the wafer has been ground to the proper contour, the wafer is rinsed with a liquid to remove particles produced by the grinding operation and is then dried.

The drying operation is performed by rotating the disc at relatively high speed to remove the washing liquid by centrifugal action and to provide rapid drying which permits increased production of the wafers.

Other processing operations may be performed on the wafer. For example, the upper surface may be mechanically cleaned by rotating the wafer at low speed while a brush is engaged with the upper surface. A coating operation may also be performed on the upper surface while the wafer is rotated at low speed.

The silicon wafer is quite thin and is relatively fragile, and it is very important to maintain good contact at all times between the grinding wheel and the periphery of the wafer. Slack or rebounding in the drive can result in skipping or chattering of the engagement of the grinding wheel with the periphery of the wafer during the contouring of the periphery of the wafer. Any such skipping or chattering can result in improper grinding or even breakage of the disc and can produce an unacceptable amount of rejects.

The chuck used for wafer processing machines of this kind is often a vacuum chuck which grips the undersurface of the wafer. The drive system must provide a steady, precise drive to prevent the wafer from being shifted off-center (or pushed off the chuck entirely) by the forces produced in the grinding, cleaning or other processing operations.

SUMMARY OF THE INVENTION

It is a primary object of the present invention to construct a two-motor drive mechanism for a silicon wafer processing machine which provides the relatively low and precisely controlled speed positive drive during grinding of the contour and cleaning of the surface operations and which also produces the relatively high speeds required for fast and efficient washing and drying.

The drive mechanism of the present invention comprises a vacuum-actuated chuck mechanism which holds the wafer on top of the chuck with the periphery of the wafer extending outwardly from the chuck for engagement by the grinding wheel.

A drive shaft is connected to rotate the chuck.

A high-speed motor is directly connected to the drive shaft to rotate the chuck and wafer in one direction of rotation at high speed during the rinsing and drying operations.

The drive mechanism also includes a low-speed motor. The low-speed motor is connected to the drive shaft through an overrunning clutch. The low-speed motor rotates the chuck and wafer at low speed during the grinding operation and in the same direction of rotation that the high-speed motor rotates the chuck and wafer during the rinsing and drying operation.

The overrunning clutch permits the high-speed motor to overrun the low-speed motor to rotate the chuck and wafer at high speed when the high speed motor is energized for the rinsing and drying operation.

The low-speed motor is, in a preferred embodiment of the present invention, a gear motor which rotates the chuck in the range of 2 to 20 rpm at a relatively high torque.

The high-speed motor is a relatively low-torque motor which rotates the chuck and wafer during the washing and drying operation in the range of 800 to 7,000 rpm.

Depending upon the initial configuration of the periphery of the wafer, and other factors, the grinding operation may tend, at times, to cause the wafer to rotate faster than the speed at which the low-speed motor is driving the chuck. This can result in slippage through the overrunning clutch.

This kind of slack in the low-speed drive can produce a chattering of the engagement between the grinding wheel and the periphery of the wafer, and the chattering can damage the wafer.

The present invention provides a bias on the drive shaft in a direction counter to the direction in which the low-speed clutch is rotating the drive shaft and chuck to insure against any such forward slipping through the overrunning clutch during grinding. This bias is produced, in a preferred embodiment of the present invention, by energizing the high-speed motor to rotate the drive shaft in a direction counter to that at which the low-speed motor is rotating the drive shaft. Because the low-speed motor has a much higher torque than the high-speed motor, the drive shaft is rotated in the direction of rotation produced by the low-speed motor, but the amount of bias produced by the attempted counter-rotation of the high-speed motor is sufficient to insure against any forward slippage through the overrunning clutch. The wafer therefore cannot slip forward or produce any chattering during the edge-contouring operation, regardless of how irregular the initial periphery of the wafer might be.

The drive mechanism also comprises a vacuum system which is operatively associated with the drive shaft and the chuck in a way to exert a vacuum on the lower surface of the wafer. The vacuum maintains the wafer in non-slipping engagement with the top surface of the chuck during all of the grinding, washing and drying operations performed on the wafer.

Drive mechanism and methods for a machine for processing silicon wafers which incorporate the structure and techniques described above and which are effective to function as described above constitute specific objects of this invention.

Other and further objects of the present invention will be apparent from the following description and claims and are illustrated in accompanying drawings which, by way of illustration, show preferred embodiments of the present invention and the principles thereof and what are not considered to be the best modes contemplated for applying these principles. Other embodiments of the invention embodying the same or equivalent principles may be used, and structural changes may be made as desired by those skilled in the art without departing from the present invention and the purview of the appended claims.

DESCRIPTION OF THE PREFERRED EMBODIMENT

Figure 1:
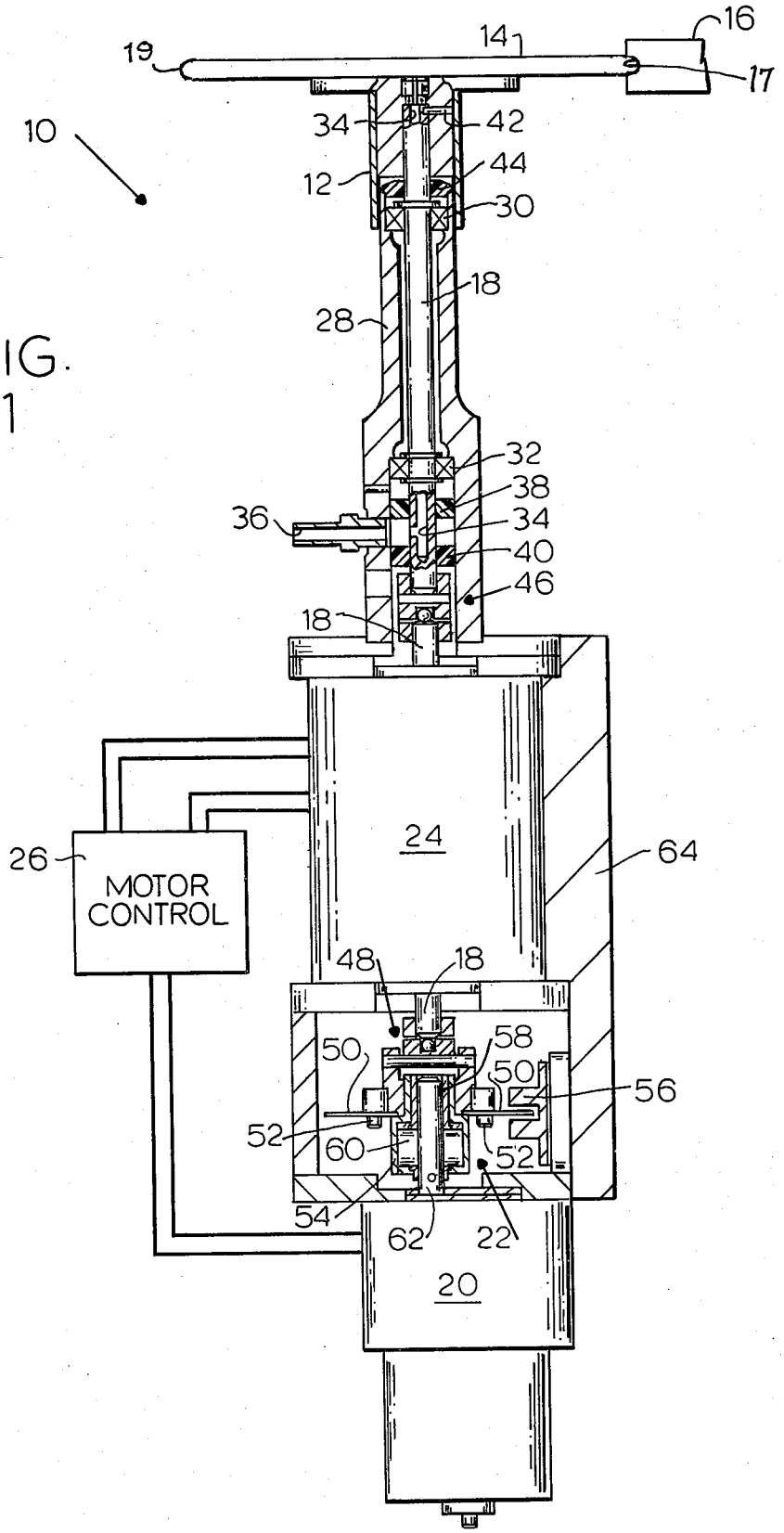
FIG. 1 is an elevation view, partly broken away in cross section to show details of construction, of a drive mechanism constructed in accordance with one embodiment of the present invention.

A drive mechanism for a wafer processing machine is indicated generally by the reference number 10 in FIG. 1

The drive mechanism includes a chuck 12 which holds and supports a silicon wafer 14 on the top surface of the chuck. The chuck 12 supports the wafer from the bottom surface of the wafer so that the periphery of the wafer extends outwardly from the chuck for engagement by a grinding wheel 16. The grinding wheel has a concavely curved surface 17 which removes the sharp edges on the top and bottom of the wafer to contour the periphery of the wafer to the semicircular finished contour 19 shown at the left hand side of the wafer in FIG. 1.

The chuck 12 is rotated by a drive shaft 18, and the grinding wheel 16 is held in a fixed position, or is moved laterally with respect with the wafer 14, to grind the desired contour on the periphery of the wafer as the wafer is rotated at low speed by the drive shaft 18.

The drive shaft 18 is driven at low speed during the grinding operation by a low-speed motor 20 through an overrunning clutch 22 (as will be described in greater detail below).

After the periphery of the wafer 14 has been ground to the desired contour, the wafer is cleaned and dried in a rinsing and drying operation, and the high-speed motor 24 rotates the chuck 12 and wafer 14 at relatively high speed during the rinsing and drying operation.

A motor control 26 controls the energization of the motors 20 and 24.

The shaft 18 is mounted for rotation within a housing 28 by bearings 30 and 32.

The shaft 18 has an axially extending inner bore 34 which is connected to a vacuum line 36. Seals 38 and 40 permit air to be evacuated from the bore 34 while the shaft if rotating, and the vacuum thus produced is transmitted to the under surface of the wafer 14 to thereby keep the wafer 14 firmly and securely in place on the top surface of the chuck 12.

The chuck 12 is connected for rotation with the shaft 18 by a key 42.

A seal 44 seals the top of the housing 28.

The high-speed motor 24 is directly connected to the drive shaft 18 (through a flexible coupling 46).

The drive shaft 18 extends through the high-speed motor 24, and the lower end of the drive shaft 18 is connected to the overruning clutch 22 through a flexible coupling 48.

An optical encoder disc 50 (connected for rotation with the shaft 18 by screws 52) and a solid state optical switch 56 (mounted on the frame 60) allow the machine logic to know the precise amount of rotation during a grinding process.

The overruning or one-way clutch 22 includes a carrier 58 with a plurality of cam rollers 60. These rollers 60 are rotated into driving engagement with the housing 54 by rotation of the shaft 62 in a given direction of rotation by the low-speed motor 20, assuming that there is nothing to cause the outer housing 54 to rotate at a higher rpm than the rotation of the shaft 62. If the housing 54 is rotated at a higher rpm than the rpm of the shaft 62, as upon energization of the high-speed motor 24 in the same direction of drive of the low-speed motor 20, the housing 54 and the drive shaft 18 overrun the cams 60 and the low-speed motor.

The entire drive mechanism is mounted in its own sub-frame 64, and the sub-frame is mounted in the frame of the grinding machine.

The low-speed motor 20, in a particular embodiment of the present invention, is a gear motor which rotates the drive shaft 18 at a speed in the range of two to twenty rpm and produces a relatively high torque.

The high-speed motor 24, in a particular embodiment of the present invention is a permanent magnet, brush-type motor which rotates the drive shaft 18 in the range of 800 to 7,000 rpm at a relatively low torque.

It is an important feature of the present invention that the high-speed motor 24 not only drives the drive shaft 18 during the rinsing and drying operation but also serves to provide a reverse bias on the drive shaft 18 in opposition to the direction of drive produced by the low-speed motor 20 during the grinding operation to maintain positive drive at all times through the overrunning clutch 22 during the grinding operation.

Irregularities in the outer edge of the wafer 14 can cause the wafer 14 to tend to momentarily rotate faster than the speed at which it is being driven by the low-speed motor 20, and this can cause chattering between the engagement of the grinding wheel 16 and the edge of the wafer 14 and sometimes can result in damage to the wafer and produce a reject.

The motor control 26 of the present invention energizes the high-speed motor 24 toward rotation in a direction opposite to that produced by the low-speed motor 20 during the grinding operation so that the high-speed motor produces a biasing effect which prevents any such overrunning through the one-way clutch 22 during the low-speed grinding operation. Since the torque produced by the high-speed motor 24 is substantially less than that produced by the low-speed motor 20, the wafer 14 is rotated in the proper direction even though the high-speed motor is energized toward rotation in a direction opposed to that of the low-speed motor 20.

In operation, the low-speed motor 20 is energized by the motor control 26 to rotate the drive shaft 18, chuck 12 and wafer 14 in one direction of rotation during the edge contouring grinding operation.

The high-speed motor 24 is then energized by the motor control 26 to rotate the drive shaft 18 and wafer 14 in the same direction of rotation but at higher speed during the rinsing and drying operation.

And, as noted above, the motor control 26 energizes the high-speed motor 24 toward rotation in a direction opposed to the rotation produced by the low-speed motor during the grinding operation to prevent any overruning through the one-way clutch 22 during the low-speed grinding operation.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A drive mechanism for a wafer processing machine of the kind in which a silicon wafer is held on the top of a rotatable chuck and is rotated at a relatively low and precisely controlled speed during a first processing operation, such as an edge contouring or upper surface cleaning operation, and in which the wafer is then rotated at high speed during a subsequent operation, such as rinsing and drying, said drive mechanism comprising, a chuck constructed to hold a wafer on top of the chuck with the periphery of the wafer extending outwardly from the chuck, a drive shaft connected to rotate the chuck, low-speed gear motor means operatively connected with the drive shaft for rotating the chuck and wafer in one direction of rotation with relatively high torque at low speed during the first processing operation, high-speed motor means directly connected to the drive shaft for rotating the chuck and wafer in said one direction of rotation with relatively low torque at high speed during the subsequent processing operation, the operative connection between the low-speed motor means and the drive shaft including overrunning clutch means for permitting the high-speed motor means to overrun the low-speed motor means and to rotate the chuck and wafer in said one direction of rotation at high speed during the subsequent processing operation and biasing means for energizing the high-speed motor toward rotation in a direction opposed to said one direction and for applying a counter torque to the drive shaft in a direction counter to the direction of rotation of the drive shaft by the low-speed motor means to insure against any slack or rebounding through the overrunning clutch means which could result in the wafer rotating, momentarily or continuously, at a speed greater than the low-speed motor and thereby producing loss of speed control or chattering during the first processing operation.

* * * * *